US009301634B1

(12) United States Patent
Toder

(10) Patent No.: US 9,301,634 B1
(45) Date of Patent: Apr. 5, 2016

(54) PARTITION CURTAIN AND ITS METHOD OF FABRICATION

(76) Inventor: Ellis Toder, Huntingdon Valley, PA (US)

( * ) Notice: Subject to any disclaimer, the term of this patent is extended or adjusted under 35 U.S.C. 154(b) by 144 days.

(21) Appl. No.: 13/070,441

(22) Filed: Mar. 23, 2011

(51) Int. Cl.
*A47H 1/00* (2006.01)
*A47H 23/10* (2006.01)
*A47H 23/02* (2006.01)

(52) U.S. Cl.
CPC ..... *A47H 23/10* (2013.01); *A47H 23/02* (2013.01)

(58) Field of Classification Search
CPC ..... A47H 23/08; A47H 23/10; A47H 23/02; A47H 2023/025; A47H 1/00; A47H 23/00; A47H 2023/02
USPC ..... 160/237, 330, 405
See application file for complete search history.

(56) References Cited

U.S. PATENT DOCUMENTS

| | | | | |
|---|---|---|---|---|
| 3,321,003 | A * | 5/1967 | Boerner | 160/237 |
| 4,377,195 | A * | 3/1983 | Weil | 160/237 |
| 6,254,527 | B1 * | 7/2001 | August | 600/27 |
| 6,474,396 | B1 * | 11/2002 | Toder | 160/237 |
| 7,989,046 | B2 * | 8/2011 | DiNunzio | 428/99 |
| 8,158,043 | B2 * | 4/2012 | Gibson et al. | 264/156 |
| 2007/0261803 | A1 * | 11/2007 | Alexander et al. | 160/341 |
| 2008/0087389 | A1 * | 4/2008 | Govan | 160/330 |
| 2012/0018106 | A1 * | 1/2012 | Robledo | 160/330 |

* cited by examiner

*Primary Examiner* — Syed A Islam
*Assistant Examiner* — Jeremy Ramsey
(74) *Attorney, Agent, or Firm* — LaMorte & Associates, P.C.

(57) ABSTRACT

A system and method of fabricating a partition curtain. The partition curtain is made from non-woven synthetic material. The partition curtain is made without sewing. Accordingly, the partition curtain has no seams that can harbor contaminants or initiate tearing. A mesh pattern is cut into the non-woven material. The mesh pattern runs parallel to the top edge and bottom edge of the curtain. The partition curtain is solid both below the mesh section and above the mesh section. Grommets are set into the partition curtain above the mesh section so that the curtain can be hung from a curtain track. Graphics can be printed onto the front and rear surfaces of the partition curtain.

11 Claims, 3 Drawing Sheets

PARTITION CURTAIN AND ITS METHOD OF FABRICATION

BACKGROUND OF THE INVENTION

1. Field of the Invention

In general, the present invention relates to the structure of partition curtains of the type that are commonly used to partition a hospital room. More particularly, the present invention relates to the structure, materials and methodologies used to manufacture such partition curtains.

2. Prior Art Description

Partition curtains, sometimes called cubical curtains, are curtains that are used to subdivide a room into separate sections. Hospitals often use partition curtains to provide privacy to exam areas, patient beds and the like. Hospitals use partition curtains because they provide far more logistical flexibility than do constructed walls. Curtains can be drawn when needed and retracted when not needed. Additionally, areas defined by partition curtains do not need light switches and other building code requirements that would be necessary for an area defined by constructed walls.

Prior art partition curtains are traditionally made from woven fabrics that are treated with flame retardant chemicals. In a commercial setting, such as a hospital, a partition curtain has a mesh section near its top and a solid bottom section that provides privacy. The mesh section near the top of the partition curtain is required by the National Fire Protection Agency (NFPA). The suggestion for curtain mesh is seventy-percent (70%) open, therein allowing for ceiling sprinkler head water penetration in the event of a fire. The vertical length requirement for the mesh section is determined by the fire code. The minimum vertical mesh length required is eighteen inches. Accordingly, most partition curtains are made with a mesh size of eighteen inches. The code for the vertical mesh requirement is found under National Fire Protection Agency code #701/large and small scale (NFPA-701).

The lower portion of a partition curtain is typically opaque to ensure patient privacy. The mesh section of the partition curtain is traditionally sewn to the lower opaque portion of the curtain along long horizontal seams. Furthermore, there is typically as small header section of solid material above the mesh section that holds grommets and enables the partition curtain to engage hooks on a curtain track. This solid header section is also sewn to the mesh section along long horizontal seams.

The need to sew together some prior art partition curtains greatly increases the cost of manufacturing such curtains. Furthermore, the sewn seams can harbor bacteria and other contaminants, therein making the partition curtains more difficult to clean and disinfect. The presence of the sewn seams also provides natural tear points where prior art partition curtains could potentially tear when snagged or pulled.

Even if a partition curtain is made using a railroaded outlay of fabric that has no central seams, the edges of the woven fabric is cuffed and sewn. Consequently, the use of woven fabric results in the curtain having sewn seams.

A need therefore exists for a partition curtain that meets the national fire code, yet contains no sewn seems. In this manner, a partition curtain can be made to be both more sanitary and less expensive. This need is met by the present invention as described and claimed below.

SUMMARY OF THE INVENTION

The present invention is a partition curtain and the method used to fabricate the partition curtain. The partition curtain is made from non-woven synthetic material, such as non-woven polyester, non-woven polyethylene terephthalate, or non-woven polypropylene. The partition curtain is made without sewing. Accordingly, the partition curtain has no seams that can harbor contaminants or initiate tearing.

A mesh pattern is cut into the non-woven material. The mesh pattern runs parallel to the top edge and bottom edge of the curtain. The pattern creates a mesh section within the partition curtain that is at least seventy percent open. The mesh section is preferably eighteen inches wide, however, other widths can be used.

The partition curtain is solid both below the mesh section and above the mesh section. Grommets are set into the partition curtain above the mesh section so that the curtain can be hung from a curtain track.

Graphics can be printed onto the front and rear surfaces of the partition curtain. Since the partition curtain is a single sheet of solid material, a graphic image can be printed onto the partition curtain that extends through all sections of the curtain. Furthermore, custom graphics can be printed onto the partition curtain without increasing the cost or complexities of manufacture.

The result is a partition curtain that is inexpensive, low maintenance, sanitary, easy to customize and meets all applicable fire and safety regulations.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

The present invention partition curtain can be used in many commercial settings, such as cubical partition in a business office. However, the present invention partition curtain is particularly well suited for use in hospitals and like environments where sanitary conditions are of the highest importance. Accordingly, the exemplary embodiment illustrated shows the partition curtain used as a hospital curtain. The exemplary embodiment is merely exemplary of the best mode contemplated for the invention and should not be considered a limitation when interpreting the scope of the appended claims.

Figure 1:
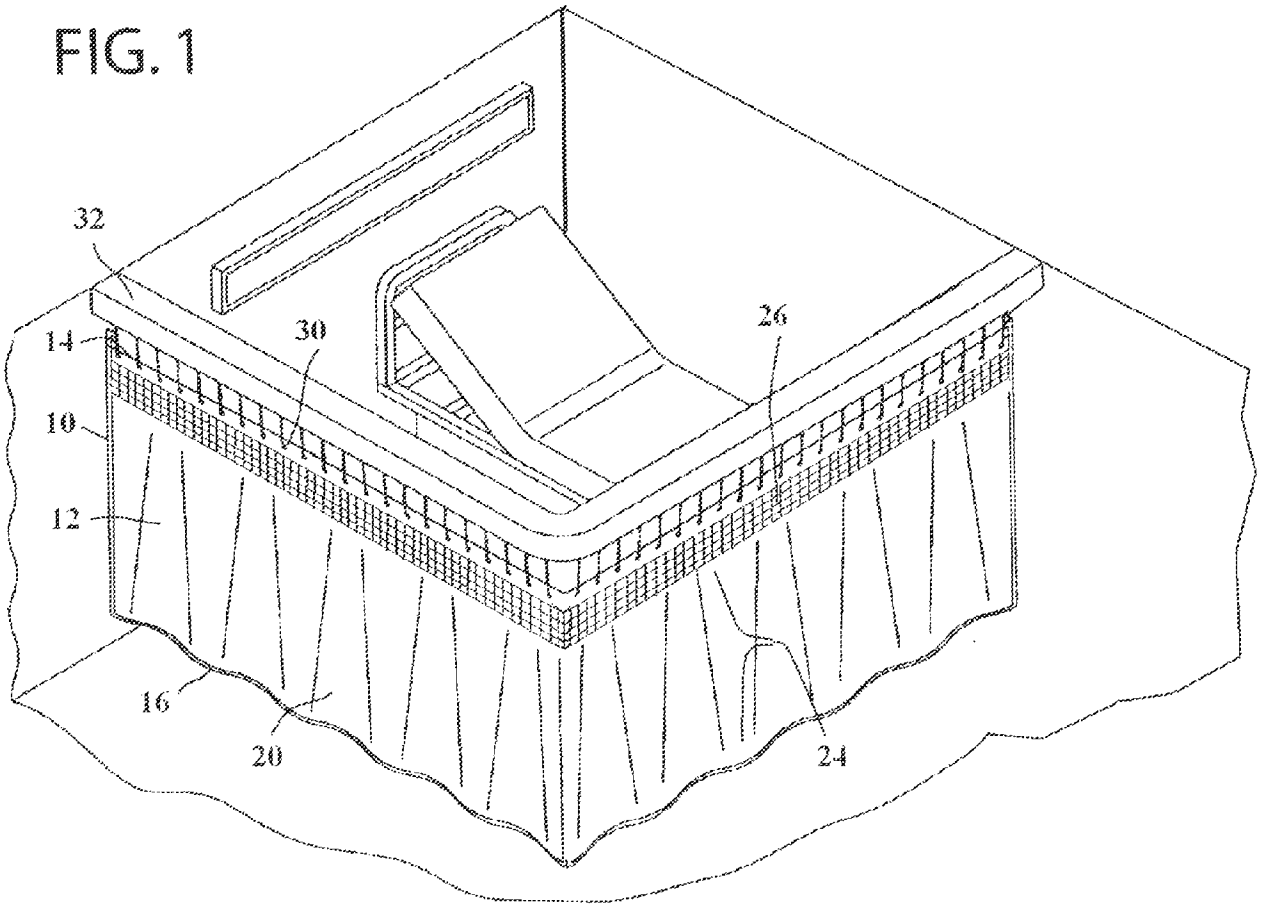
FIG. 1 is a perspective view of an exemplary embodiment of a partition curtain hanging from a ceiling track.
Figure 2:
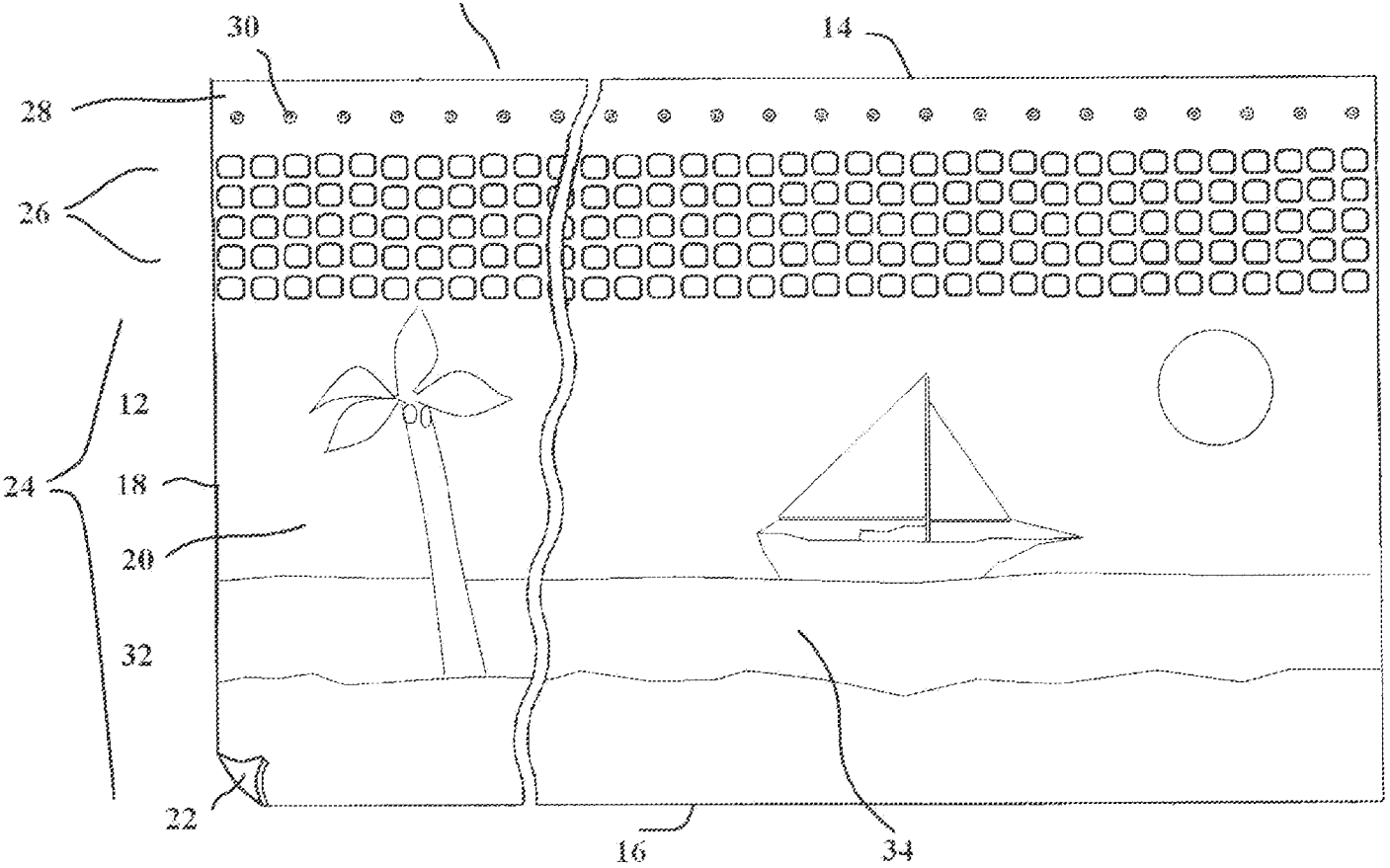
FIG. 2 is a front view of the partition curtain shown in FIG. 1.

Referring to FIG. 1 in conjunction with FIG. 2, an exemplary partition curtain 10 is shown. The partition curtain 10 is fabricated from a single unistructural piece of non-woven synthetic material 12. The preferred material 12 for the partition curtain 10 is non-woven polyethylene terephthalate (PET) or non-woven polypropylene. The non-woven material 12 is either mixed with, or coated with, flame retardants so that the partition curtain 12 meets the national fire safety code regulations. Non-woven materials, such as those listed, are not organic and therefore cannot directly nurture bacteria. Furthermore, such materials are highly tear resistant, durable, and low cost. Unlike many woven natural fabrics, the non-woven material 12 is hydrophobic and does not readily absorb water. Consequently, if blood, urine, bile or any other bodily fluid were to come into contact with the partition curtain 10, that liquid would tend to stand on the material 12 and not be absorbed. This makes the partition curtain 10 easier to clean. Furthermore, the material 12 can be treated to make the material 12 even more hydrophobic and/or to add antimicrobial properties to the fabric.

The partition curtain 10 is machine washable in an ordinary washing machine. As such, the partition curtain 10 is easy to keep both clean and sanitary. Furthermore, since the partition curtain 10 is unistructural, it contains no sewn seam lines that can harbor contaminants and/or initiate tears.

The partition curtain 10 has a top edge 14 and a bottom edge 16. The partition curtain 10 has a predetermined height between the top edge 14 and the bottom edge 16 that typically falls between seven feet and nine feet. The partition curtain 10 also has a predetermined length between vertical side edges 18. Both the length and the width of the partition curtain 10 can be custom ordered. However, the width of the partition curtain 10 is preferably between six feet and eighteen feet.

The partition curtain 10 has a face surface 20 and a rear surface 22 that are defined between the top edge 14, the bottom edge 16, and the two vertical side edges 18. Both the face surface 20 and the rear surface 22 share the same sections between the vertical side edges 18. The partition curtain 10 has a solid lower section 24, a mesh section 26 and a solid top header section 28. The mesh section 26 is located and sized to meet national fire safety standards. That is, the mesh section 26 is at least seventy percent open space and has a preferred height eighteen inches. The header section 28 extends from the mesh section 26 to the top edge 14 and is only wide enough to provided the needed support to grommets 30. Grommets 30 are inserted into the header section 28 so that the partition curtain 10 can be easily hung from a hospital curtain track 32. The solid lower section 24 extends from the mesh section 26 to the bottom edge 16 of the partition curtain 10.

Both the face surface 20 and the rear surface 22 of the partition curtain 10 can be plain. However, if an aesthetically pleasing graphics 34 can be printed on one or both of these surfaces. The printed graphics 34 extend through all the sections of the partition curtain 10, thereby providing the overall partition curtain 10 with uniform aesthetics between its top edge 14 and bottom edge 16.

Figure 3:
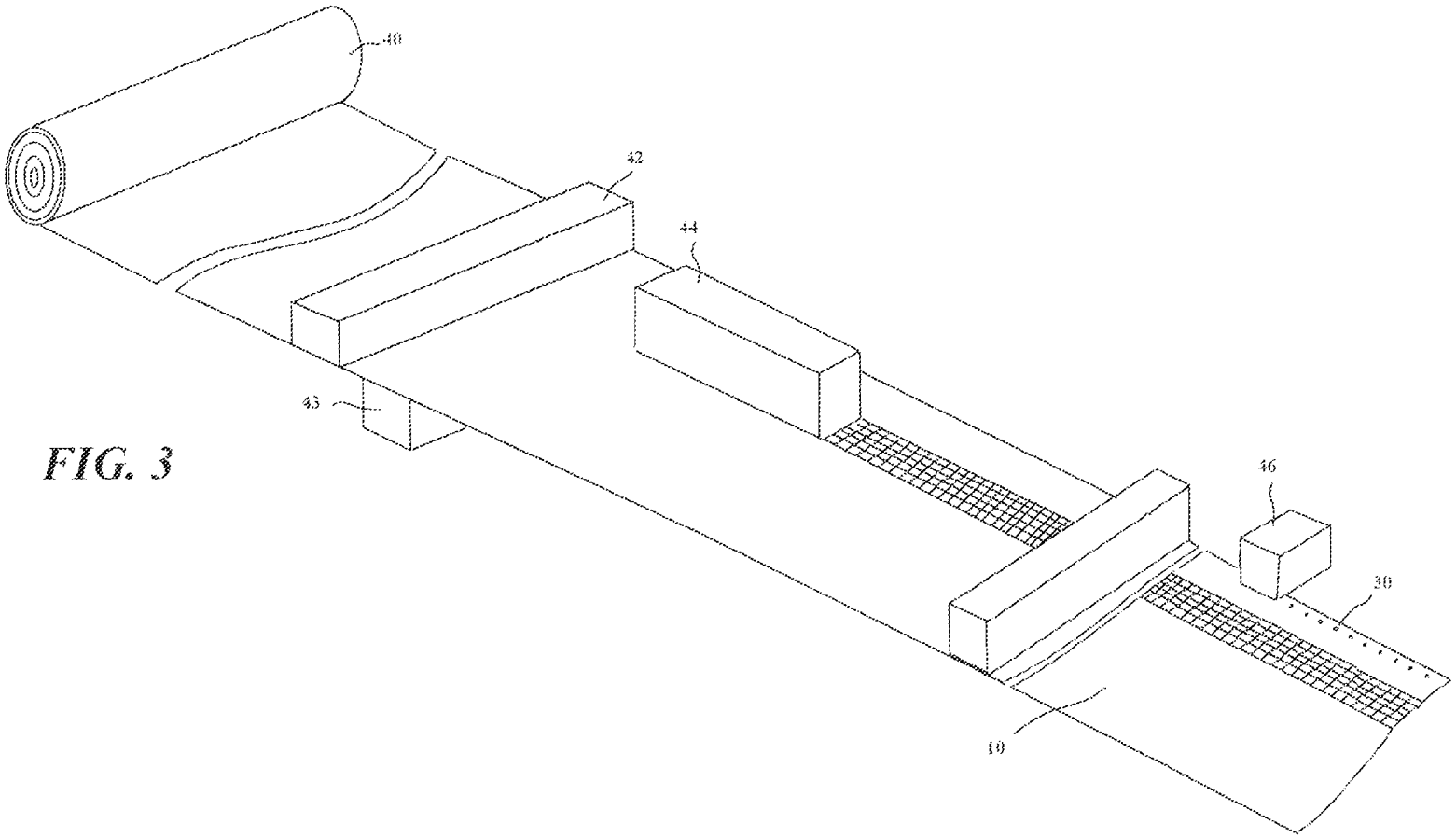
FIG. 3 is a schematic illustrating an exemplary method of manufacture for the partition curtain.

Referring to FIG. 3 in conjunction with FIG. 2, the method of manufacturing the partition curtain 10 is described. The partition curtains 10 starts out as a roll 40 of non-woven material. The roll 40 is as wide as the partition curtain 10 is tall. Accordingly, the edges of the roll create the top edge 14 and the bottom edge 16 of the partition curtain 10. The non-woven material 12 is then advanced through a commercial bed printer 42 or silkscreen printer that prints graphics 34 onto the non-woven material 12. If graphics 34 are to be printed onto both sides of the non-woven material 12, a second printer 43 is used. Since the graphics 34 being printed are printed onto the non-woven material 12 rather than dyed into the fabric, it will be understood that the graphics can be changed simply by loading a different digital image file to the printers 42, 43 or placing a different screen into the silkscreen printer. Accordingly, hospitals can order partition curtains with customized images without increasing the cost or complexity of the manufacturing process.

The non-woven material 12, now bearing the printed graphics 34, are then advanced through a pattern cutting stamp 44. The pattern cutting stamp 44 cuts openings through the non-woven material 12, therein creating the mesh section 26 of the partition curtain 10. The stamped material is then advanced through a grommet machine 46 that sets grommets 30 into the header section 28 above the mesh section 26. The non-woven, printed, stamped and grommeted material is then cut into different length and widths to create partition curtains 10 of desired length and widths.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A method of fabricating a partition curtain of a predetermined length and a predetermined height, said method comprising the steps of:

providing a roll of non-woven material containing no seams and no stitching, said roll of non-woven material having a width between a first edge and a second edge that is at least as wide as said predetermined height of said partition curtain, wherein said non-woven material is selected from a group consisting of non-woven polyethylene terephthalate and non-woven polypropylene, and wherein said non-woven material is incapable of directly nurturing bacteria;

creating a mesh section in said non-woven material by cutting a mesh pattern into said non-woven material that runs parallel to both said first edge and said second edge; and setting grommets into said non-woven material between said mesh section and said first edge.

2. The method according to claim 1, further including the step of printing graphics onto said non-woven material.

3. The method according to claim 2, wherein said non-woven material has a face surface and a rear surface and said step of printing graphics includes printing graphics onto both said face surface and said rear surface.

4. The method according to claim 1, wherein said step of creating a mesh section in said non-woven material includes creating a mesh section that is at least seventy percent open and eighteen inches wide.

5. The method according to claim 1, wherein a solid header section exists between said mesh section and said first edge, and wherein said step of setting grommets into said non-woven material includes setting said grommets into said solid header section.

6. The method according to claim 1, further including the step of cutting said non-woven material from said roll in lengths equal to said predetermined width of said partition curtain.

7. A method of fabricating a partition curtain of a predetermined length and a predetermined height, said method comprising the steps of:

providing a solid sheet of non-woven material having a top edge, a bottom edge, a face surface and a rear surface, wherein said solid sheet of non-woven material is selected from a group consisting of non-woven polyethylene terephthalate and non-woven polypropylene and contains no stitching and no seams, wherein said non-woven material is incapable of directly nurturing bacteria;

printing graphics onto said non-woven material; and cutting a mesh pattern into said non-woven material that runs parallel to both said top edge and said bottom edge, therein creating a mesh section of said partition curtain, a solid section that extends from said bottom edge to said mesh section, and a header section that extends from said mesh section to said top edge.

8. The method according to claim 7, further including the step of setting grommets into said header section.

9. The method according to claim 7, wherein said step of printing graphics includes printing graphics onto both said face surface and said rear surface.

10. The method according to claim 7, wherein said step of cutting a mesh pattern in said non-woven material includes cutting a mesh pattern that is at least seventy percent open and eighteen inches wide.

11. The method according to claim 7, further including the step of cutting said non-woven material from a roll in lengths equal to said predetermined width of said partition curtain.

* * * * *